US006877941B2

(12) United States Patent
Brifcani et al.

(10) Patent No.: US 6,877,941 B2
(45) Date of Patent: Apr. 12, 2005

(54) CAN END AND METHOD FOR FIXING THE SAME TO A CAN BODY

(75) Inventors: Mouayed Mamdooh Brifcani, Oxfordshire (GB); Peter James Hinton, Swindon (GB); Mark Christopher Kysh, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 10/741,492

(22) Filed: Dec. 19, 2003

(65) Prior Publication Data

US 2004/0129710 A1 Jul. 8, 2004

Related U.S. Application Data

(62) Division of application No. 10/024,862, filed on Dec. 18, 2001, which is a continuation of application No. 09/650,664, filed on Aug. 30, 2000, now abandoned, which is a continuation of application No. 09/552,668, filed on Apr. 19, 2000, now abandoned, which is a continuation of application No. 08/945,698, filed as application No. PCT/GB96/00709 on Mar. 25, 1996, now Pat. No. 6,065,634.

(30) Foreign Application Priority Data

May 24, 1995 (GB) ..... 9510515

(51) Int. Cl.[7] ..... B21D 51/32
(52) U.S. Cl. ..... 413/31
(58) Field of Search ..... 413/27, 31, 37

(56) References Cited

U.S. PATENT DOCUMENTS

| | | | | |
|---|---|---|---|---|
| 3,023,927 A | 3/1962 | Ehman | ..... | 220/619 |
| 3,526,486 A | 9/1970 | Smith et al. | ..... | 291/835 |
| 3,843,014 A | 10/1974 | Cospen et al. | ..... | 220/623 |
| 3,967,752 A | 7/1976 | Cudzik | ..... | 220/269 |

(Continued)

FOREIGN PATENT DOCUMENTS

| | | | |
|---|---|---|---|
| DE | G 92 11 788.0 | | 1/1993 |
| EP | 0 153 115 A2 | A3 | 8/1985 |
| EP | 0 340 955 | A1 | 11/1989 |
| GB | 1444470 | | 7/1976 |
| GB | 2 143 202 | | 2/1985 |
| GB | 2 196 891 | | 5/1988 |
| GB | 2 218 024 | | 11/1989 |
| JP | 57-117323 | | 7/1982 |
| JP | 01167050 A | * | 6/1989 |
| WO | WO 93/17864 | | 9/1993 |

OTHER PUBLICATIONS

United States Brewers Association, Inc., "Brewing Industry Recommended Can Specifications Manual," pp. 1–1, 2–1, and 3–2, Washington, DC, May 1983.
Society of Soft Drink Technologists, "Beverage Can, End, & Double Seam Dimensional Specifications," pp. 2, 1B–2 to 5, Hartfield, VA, Fourth Revision, Aug. 1993.

(Continued)

*Primary Examiner*—Lowell A. Larson
(74) *Attorney, Agent, or Firm*—Woodcock Washburn LLP

(57) ABSTRACT

A can end includes a peripheral cover hook a chuck wall dependent from the interior of the cover hook, an outwardly concave annular reinforcing bead extending radially inwards from the chuck wall, and a central panel supported by an inner portion of the reinforcing bead, characterized in that, the chuck wall is inclined to an axis perpendicular to the exterior of the central panel at an angle between 20° and 60°, and the concave cross-sectional radius of the reinforcing bead is less than 0.75 mm.

23 Claims, 4 Drawing Sheets

U.S. PATENT DOCUMENTS

| | | | | | |
|---|---|---|---|---|---|
| 4,015,744 | A | | 4/1977 | Brown | 220/269 |
| 4,024,981 | A | | 5/1977 | Brown | 220/269 |
| 4,093,102 | A | | 6/1978 | Kraska | 220/623 |
| 4,148,410 | A | | 4/1979 | Brown | 220/269 |
| 4,150,765 | A | | 4/1979 | Mazurek | 220/269 |
| 4,210,257 | A | | 7/1980 | Radtke | 220/269 |
| 4,217,843 | A | | 8/1980 | Kraska | 413/12 |
| 4,276,993 | A | | 7/1981 | Hasegawa | 220/269 |
| 4,286,728 | A | | 9/1981 | Fraze et al. | 220/270 |
| 4,365,724 | A | | 12/1982 | Walden | 220/611 |
| 4,402,421 | A | | 9/1983 | Ruemer, Jr. | 220/269 |
| 4,448,322 | A | * | 5/1984 | Kraska | 220/623 |
| D279,265 | S | | 6/1985 | Turner et al. | D9/438 |
| 4,559,801 | A | * | 12/1985 | Smith et al. | 72/348 |
| 4,578,007 | A | | 3/1986 | Diekhoff | 413/6 |
| 4,606,472 | A | | 8/1986 | Taube et al. | 220/500 |
| D285,661 | S | | 9/1986 | Brownbill | D9/435 |
| 4,674,649 | A | | 6/1987 | Pavely | 220/271 |
| 4,681,238 | A | | 7/1987 | Sanchez | 220/260 |
| 4,685,582 | A | | 8/1987 | Pulciani et al. | 220/606 |
| 4,716,755 | A | | 1/1988 | Bulso, Jr. et al. | 72/349 |
| 4,782,594 | A | | 11/1988 | Porucznik et al. | 30/417 |
| 4,808,052 | A | | 2/1989 | Bulso, Jr. et al. | 413/8 |
| 4,809,861 | A | | 3/1989 | Wilkinson et al. | 220/623 |
| D300,608 | S | | 4/1989 | Taylor et al. | D9/438 |
| D304,302 | S | | 10/1989 | Dalli et al. | D9/438 |
| 4,893,725 | A | | 1/1990 | Ball et al. | 220/269 |
| 4,930,658 | A | | 6/1990 | McEldowney | 220/269 |
| 5,046,637 | A | * | 9/1991 | Kysh | 220/610 |
| 5,049,019 | A | * | 9/1991 | Franek et al. | 413/19 |
| 5,064,087 | A | | 11/1991 | Koch | 220/269 |
| 5,129,541 | A | | 7/1992 | Voigt et al. | 220/269 |
| 5,143,504 | A | | 9/1992 | Braakman | 413/6 |
| D337,521 | S | | 7/1993 | McNulty | D9/438 |
| 5,252,019 | A | | 10/1993 | Saunders et al. | 413/67 |
| D347,172 | S | | 5/1994 | Heynen et al. | D9/520 |
| 5,356,256 | A | | 10/1994 | Turner et al. | 413/8 |
| D352,898 | S | | 11/1994 | Vacher | D9/438 |
| 5,494,184 | A | | 2/1996 | Noguchi et al. | 220/269 |
| 5,582,319 | A | | 12/1996 | Heyes et al. | 220/62.22 |
| 5,839,869 | A | * | 11/1998 | Moran et al. | 413/31 |
| D406,236 | S | | 3/1999 | Brifcani et al. | D9/438 |
| 5,911,551 | A | | 6/1999 | Moran | 413/31 |
| 5,957,647 | A | | 9/1999 | Hinton | 413/4 |
| 5,971,259 | A | | 10/1999 | Bacon | 229/5.6 |
| 6,024,239 | A | | 2/2000 | Turner et al. | 220/269 |
| 6,065,634 | A | | 5/2000 | Brifcani et al. | 220/619 |
| 6,089,072 | A | | 7/2000 | Fields | 72/379.4 |

OTHER PUBLICATIONS

Beverage Can "Mini Seams" by Pete Moran published by CMB Engineering Group plc contents page, pp. 3 through 30 and figures, published mid–1980s.

"Modern Beverage Can Double Seaming" published by Continental Beverage Packaging Cover page and 2 unnumbered pages, undated.

"Aluminium canstock" The Canmaker, Jan. 1994 pp. 38 through 43.

Notice of Opposition to a European Patent 96908205.6/828, 663 Opposed by American National Can–Company (Facts and Arguments), Dec. 12, 1999, 21 pages.

Letter From Ismay Ratliff Of Crown Cork & Seal To EPO, Apr. 19, 2001, One Page, Enclosing Patentee's Observations And Amendments In Response To The Opposition, 9 pages, and Summary of Main and Auxiliary Requests, Main Request, and Auxiliary Requests 1, 2, and 3, 14 pages.

Letter From PRB Lawrence Of Gill Jennings & Every To EPO, Nov. 6, 2001, Nine Pages, Beginning, "The opponent notes that the patentee has not responded to the detailed argumentation . . . " with three pages of graphics and with EPO Cover Page dated Nov. 15, 2001.

Letter From PRB Lawrence Of Gill Jennings & Every To EPO, Nov. 27, 2001, Two Pages, beginning, "I refer to the final paragraph of p. 9 of my comments of 6$^{th}$ Nov. and . . . " with three page attachment having graphics and with EPO Cover Page dated Dec. 5, 2001.

Letter from Ismay Ratliff of Crown Cork & Seal to EPO, Nov. 28, 2001, One Page, beginning, "I refer to the letter from the Opponent of 6$^{th}$ Nov. 2001".

Letter From PRB Lawrence Of Gill Jennings & Every To EPO, Dec. 11, 2001, One Page, Beginning "I not the patentee's comments of 28th November.".

Letter from Ismay Ratliff of Crown Cork & Seal to EPO, Jan. 18, 2002, One Page, beginning, "I refer to the communications of 15$^{th}$ November 2001, 5$^{th}$ December 2001, 7$^{th}$ January 2002 . . . ".

Letter from Ismay Ratliff of Crown Cork & Seal to EPO, Mar. 18, 2002, Three Pages, beginning "Further to my letter of 18$^{th}$ January 2002, I enclose further submissions in response to the Opponent's letters of 15$^{th}$ November, 27$^{th}$ November, and 11$^{th}$ December 2001" with 10 pages of claims including Main Request, Auxiliary Request , and Auxiliary Request 2.

Letter From PRB Lawrence Of Gill Jennings & Every To EPO, May 2, 2002, 7 pages, Beginning, "I maintain all the objections in the original opposition and in the submission of the 6$^{th}$ and 27$^{th}$ November 2001 . . . " with cover page from EPO dated May 16, 2002.

Letter from Ismay Ratliff of Crown Cork & Seal to EPO, Jul. 4, 2002, Four Pages, Beginning, "This is in response to the Opponents' further submissions dated 2$^{nd}$ May 2002."

Summons to Attend Oral Proceedings Pursuant to Rule 71(1) EPC, Oct. 21, 2002, 7 pages.

Letter from PRB Lawrence of Gill Jennings & Every, Jun. 24, 2002, with affidavit of Thomas T. Tung with Attachments A thru D, Jun. 14, 2002.

Letter from PRB Lawrence of Gill Jennings & Every, Jul. 19, 2002, with Extracts of the Pechiney Annual Report 1989, 5 pages, Triangle Industries, Inc., Annual Report, 1987, 2 pages.

Final submission by the EP patentee in the EPO opposition proceeding: European Patent Application No. 96908205.6 (now European Patent No. 0 828 663), CarnaudMetalbox Plc, Opposition by American National Can Company, (Copy), Feb. 11, 2003, with Attachments, 38 pages.

Final submissions by the EP opponent in the EPO opposition proceedings: European Patent Application No. 96908205.6–2308/0828663, CarnaudMetalbox Plc, (Copy), Feb. 18, 2003, with Attachments, Affidavit by John Davy, Statement of Facts of John Zappa, 53 pages.

Letter From PRB Lawrence Of Gill Jennings & Every To EPO, Feb. 19, 2003, One Page, beginning, "There are two points supplementary to my letter of 18 Feb. . . . ".

Letter From PRB Lawrence Of Gill Jennings & Every to EPO, Feb. 20, 2003, Two Pages, Beginning We Have Been Considering Further The Recent Assertion By The Patentee About The Alleged Non–Enabling Nature . . .

Interlocutory Decision of the Opposition Division of the European Patent Office in Respect of the EP Patent No. 0828663, (Copy), May 5, 2003, 25 pages.

Grounds of Appeal against the Interlocutory Decision by the Opposition Division, (Copy), filed by EP patentee, Sep. 2, 2003, European Patent No. 0 828 663 (Formerly European Patent Application No. 96908205.6) CarnaudMetalbox Plc and CarnaudMetalbox SA Appeal against the Interlocutory Decision of the Opposition Division, May 5, 2003, with attached copies of Main Request, and Auxiliary Request 1 thru 8, 32 pages.

Grounds of Appeal against the Interlocutory Decision by the Opposition Division, (Confirmation), filed by EP opponent, Sep. 12, 2003, with attachments including graphics and English translation of JP–U57–117323 and Technical Statement of Facts of Bill Hartman in Opposition to EP 828 663, with attachments, Technical Statement by Dean Scranton, Technical Statement of Facts of Christopher Sjostrom in Opposition to EP 828 663, Technical Statement by Gary Smith for Opposition to EP 828 663, Technical Statement by Timothy L. Turner, 57 pages.

Plaintiffs' Responses and Objections to Defendants' First Set of Interrogatories; Civil Action No. 03–C–0137–S; Interrogatory No. 2; pp. 1, 9, 10, and 11. (pp. 1 and 11 are redacted); dated Jun. 16, 2003.

Opinion of the Unites States District Court for the Western District of Wisconsin in *Anheuser–Busch Companies, Inc.* v. *Crown Cork & Seal Co., Inc.*; Case No. 03–C–137–S; dated Nov. 20, 2003, 35 pages.

Reply Brief in the EPO Opposition Proceeding: European Patent No. 0 828 663 (Formerly European Patent Application No. 96908205.6) CarnaudMetalbox Plc and CarnaudMetalbox SA Appeal against the Interlocutory Decision of the Opposition, Letter dated 13 May, 2004, 24 pages, Letter from James P. Tanner to Ismay Ratliff dated May 14, 2004, Beginning "This is further to our discussion on May 13, 2004 . . . ", 1 page.

Submission of Enclosed Office Action dated Feb. 3, 2004, that issued in U.S. Appl. No. 10/417,980 which claims priority to the instant application.

* cited by examiner

CAN END AND METHOD FOR FIXING THE SAME TO A CAN BODY

This a divisional of U.S. patent application Ser. No. 10/024,862, filed Dec. 18, 2001, which is a continuation of U.S. patent application Ser. No. 09/650,664, filed Aug. 30, 2000, now abandoned, which is a continuation of U.S. patent application Ser. No. 09/552,668, filed Apr. 19, 2000, now abandoned, which is a continuation of U.S. patent application Ser. No. 08/945,698, filed Nov. 21, 1997, which issued May 23, 2000 as U.S. Pat. No. 6,065,634, which is the U.S. National Phase of PCT/GB96/00709, filed Mar. 25, 1996, which claims priority to UK 9510515.1, filed May 24, 1995.

BACKGROUND OF THE INVENTION

This invention relates to an end wall for a container and more particularly but not exclusively to an end wall of a can body and a method for fixing the end wall to the can body by means of a double seam.

U.S. Pat. No. 4,093,102 (KRASKA) describes can ends comprising a peripheral cover hook, a chuck wall dependent from the interior of the cover hook, an outwardly concave annular re-inforcing bead extending radially inwards from the chuck wall and a central panel joined to an inner wall of the reinforcing bead by an annular outwardly convex bead. This can end is said to contain an internal pressure of 90 psi by virtue of the inclination or slope of the chuck wall, bead outer wall and bead inner wall to a line perpendicular to the centre panel. The chuck wall slope D° is between 14° and 16°, the outer wall slope E is less than 4° and the inner wall slope C° is between 10 and 16° leading into the outwardly convex bead. We have discovered that improvements in metal usage can be made by increasing the slope of the chuck wall and limiting the width of the anti peaking bead.

U.S. Pat. No. 4,217,843 (KRASKA) describes an alternative design of can end in which the countersink has inner and outer flat walls, and a bottom radius which is less than three times the metal thickness. The can end has a chuck wall extending at an angle of approximately 24° to the vertical. Conversely, our European Patent application EP0340955A describes a can end in which the chuck wall extends at an angle of between 12° and 20° to the vertical.

Our European Patent No. 0153115 describes a method of making a can end suitable for closing a can body containing a beverage such as beer or soft drinks. This can end comprises a peripheral flange or cover hook, a chuck wall dependant from the interior of the cover hook, an outwardly concave reinforcing bead extending radially inwards from the chuck wall from a thickened junction of the chuck wall with the bead, and a central panel supported by an inner portion of the reinforcing bead. Such can ends are usually formed from a prelacquered aluminum alloy such as an aluminum magnesium manganese alloy such as alloy 5182.

Our International Patent Application published no. WO93/17864 describes a can end suitable for a beverage can and formed from a laminate of aluminum/manganese alloy coated with a film of semi crystalline thermoplastic polyester. This polyester/aluminum alloy laminate permitted manufacture of a can end with a narrow, and therefore strong reinforcing bead in the cheaper aluminum manganese alloy.

These known can ends are held during double seaming by an annular flange of chuck, the flange being of a width and height to enter the anti-peaking bead. There is a risk of scuffing if this narrow annulus slips. Furthermore a narrow annular flange of the chuck is susceptible to damage.

Continuing development of a can end using less metal, whilst still permitting stacking of a filled can upon the end of another, this invention provides a can end comprising a peripheral cover hook, a chuck wall dependant from the interior of the chuck wall, an outwardly concave annular reinforcing bead extending radially inwards from the chuck wall, and a central panel supported by an inner portion of the reinforcing bead, characterized in that, the chuck wall is inclined to an axis perpendicular to the exterior of the central panel at an angle between 30° and 60°, and the concave bead narrower than 1.5 mm (0.060"). Preferably, the angle of the chuck wall to the perpendicular is between 40° and 45°.

In a preferred embodiment of the can end an outer wall of the reinforcing bead is inclined to a line perpendicular to the central panel at an angle between −15° to +15° and the height of the outer wall is up to 2.5 mm.

In one embodiment the reinforcing bead has an inner portion parallel to an outer portion joined by said concave radius.

The ratio of the diameter of the central panel to the diameter of the peripheral curl is preferably 80% or less.

The can end may be made of a laminate of thermoplastic polymer film and a sheet aluminum alloy such as a laminate of a polyethylene terephthalate film on an aluminum—manganese alloy sheet or ferrous metal typically less than 0.010 (0.25 mm) thick for beverage packaging. A lining compound may be placed in the peripheral cover hook.

In a second aspect this invention provides a method of forming a double seam between a can body and a can end according to any preceding claim, said method comprising the steps of:

placing the curl of the can end on a flange of a can body supported on a base plate, locating a chuck within the chuck wall of the can end to centre the can end on the can body flange, said chuck having a frustoconical drive surface of substantially equal slope to that of the chuck wall of the can end and a cylindrical surface portion extending away from the drive surface within the chuck wall, causing relative motion as between the assembly of can end and can body and a first operation seaming roll to form a first operation seam, and thereafter causing relative motion as between the first operation seam and a second operation roll to complete a double seam, during these seaming operations the chuck wall becoming bent to contact the cylindrical portion of the chuck.

BRIEF DESCRIPTION OF THE FIGURES

Various embodiments will now be described by way of example and with reference to the accompanying drawings in which.

DETAILED DESCRIPTION

Figure 1:
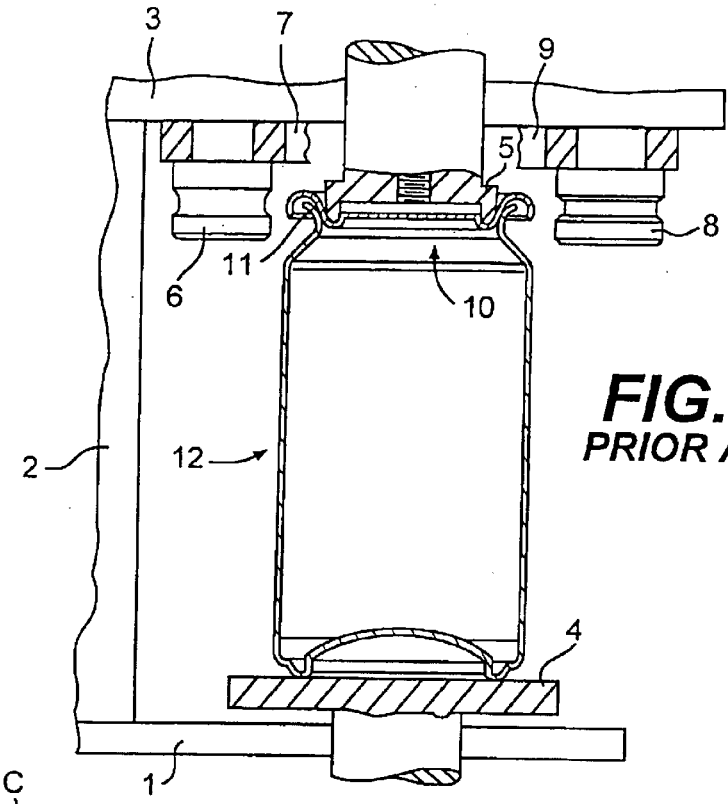
FIG. 1 PRIOR ART
FIG. 1 is a diagrammatic sketch of known apparatus for forming a double seam.

In FIG. 1, apparatus for forming a double seam comprises a base plate 1, an upright 2 and a top plate 3.

A lifter 4 mounted in the base plate is movable towards and away from a chuck 5 mounted in the top plate. The top plate supports a first operation seaming roll 6 on an arm 7 for pivotable movement towards and away from the chuck. The top plate also supports a second operation seaming roll 8 on an arm 9 for movement towards and away from the chuck after relative motion as between the first operation roll and can end on the chuck creates a first operation seam.

Figure 3:
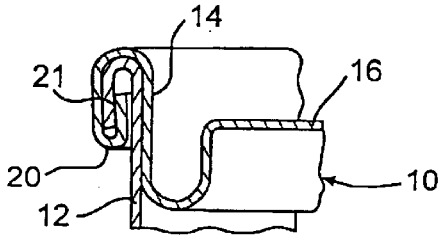
FIG. 3 PRIOR ART
FIG. 3 is a sectioned view of a fragment of a known double seam.

As shown in FIG. 1 the chuck 5 holds a can end 10 firmly on the flange 11 of a can body 12 against the support provided by the lifter plate 4. Each of the first operation roll 6 and second operation roll 7 are shown clear of chuck before the active seam forming profile of each roll is moved in turn to form the curl of the can end and body flange to a double seam as shown in FIG. 3.

Figure 2:
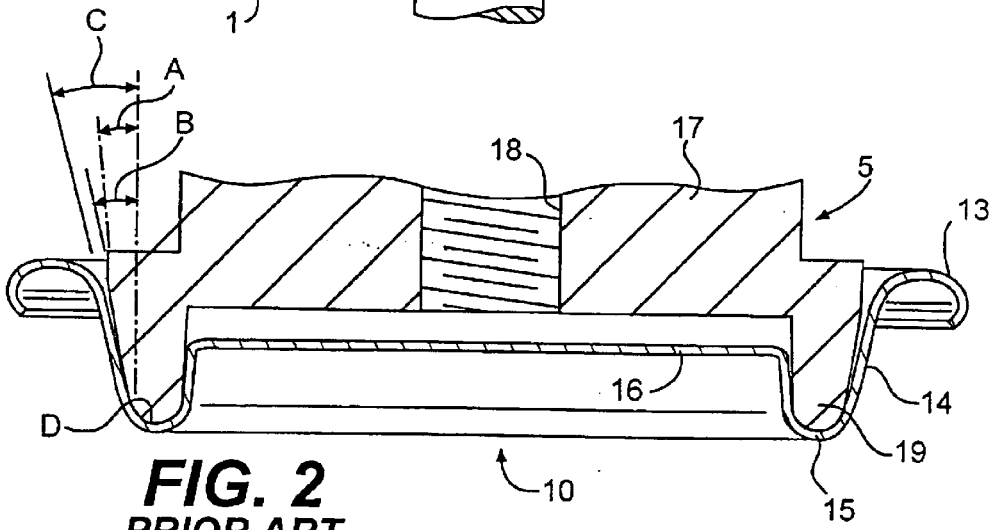
FIG. 2 PRIOR ART
FIG. 2 is an enlarged sectioned side view of a known chuck and can end before seaming.

FIG. 2 shows on an enlarged scale the chuck 5 and can end 10. The can end comprises a peripheral curl 13, a chuck wall 14 dependent from the interior of the curl, an outwardly concave anti-peaking bead 15 extending inwards from the chuck wall to support a central panel 16. Typically the chuck wall flares outwardly from the vertical at an angle C about 12° to 15°.

The chuck 5 comprises a body 17 having a threaded bore 18 permitting attachment to the rest of the apparatus (not shown). An annular bead 19 projects from the body 17 of the chuck to define with the end face of the body a cavity to receive the central panel 16 of the can end. The fit of panel 16 in annulus 19 may be slack between panel wall and chuck.

The exterior surface of the projecting bead 19 extends upwards towards the body at a divergent angle B of about 12° to the vertical to join the exterior of the chuck body 17 which tapers off an angle A° of about 4° to a vertical axis perpendicular to the central panel. The outer wall of the chuck 5 engages with the chuck wall at a low position marked "D" within the 12° shaped portion of the chuck bead 15.

As can ends are developed with narrower anti-peaking beads the chuck bead 19 becomes narrower and more likely to fracture. There is also a risk of scuffing of the can end at the drive position D which can leave unacceptable unsightly black marks after pasteurization.

FIG. 3 shows a sectioned fragment of a typical double seam showing a desirable overlap of body hook 21 and end hook 20 between the can end 10 and can body 12.

Figure 4:
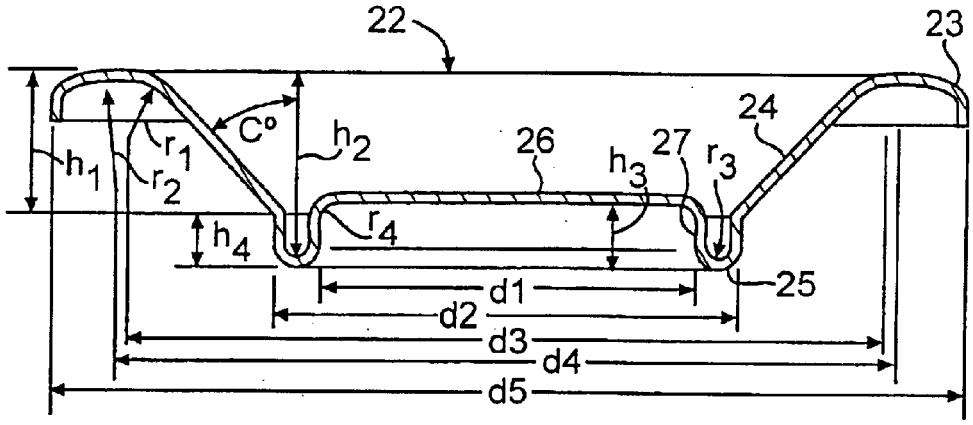
FIG. 4 is a sectioned side view of a can end according to this invention before edge curling.

FIG. 4 shows a can end, according to the invention, comprising a peripheral cover hook 23, a chuck wall 24 extending axially and inwardly from the interior of the peripheral cover hook, an outwardly concave reinforcing or anti-peaking bead 25 extending radially inwards from the chuck wall, and a central panel 26 supported or an inner portion panel with 27. The panel wall is substantially upright allowing for any metal spring back after pressing. The chuck wall is inclined to an axis perpendicular to the exterior of the central panel at an angle $C_1$ between 20° and 60°; preferably between 40° and 45°. Typically the cross sectional radius of the antipeaking bead is about 0.5 mm.

Preferably the anti-peaking bead 25 is parallel sided, however the outer wall may be inclined to a line perpendicular to the central panel at an angle between −15° to +15° and the height $h_4$ of the outer wall may be up to 2.5 mm.

This can end is preferably made from a laminate of sheet metal and polymeric coating. Preferably the laminate comprises an aluminum magnesium alloy sheet such as 5182, or aluminum manganese alloy such as 3004 with a layer of polyester film on one side. A polypropylene film may be used on the "other side" if desired.

Typical dimensions of the example of the invention are:

| | | |
|---|---|---|
| d5 | overall diameter (as stamped) | 65.83 mm |
| d4 | PC diameter of seaming panel radius | 61.54 mm |
| d3 | PC diameter of seaming panel/chuck wall radius | 59.91 mm |
| $r_1$ | seaming panel/chuck wall radius | 1.27 mm |
| $r_2$ | seaming panel radius | 5.56 mm |
| $r_3$ | concave radius in antipeaking bead | <1.5 mm |
| $d_2$ | maximum diameter of antipeaking bead | 50.00 mm |
| $d_1$ | minimum diameter of antipeaking bead | 47.24 mm |
| $h_2$ | overall height of can end | 6.86 mm |
| $h_1$ | height to top of antipeaking bead | 5.02 mm |
| $h_3$ | panel depth | 2.29 mm |
| $h_4$ | outer wall height | 1.78 mm |
| c | chuck wall angle to vertical | 43° |

From these dimensions it can be calculated that the ratio of central panel diameter of 47.24 mm to overall diameter of can end 65.84 is about 0.72 to 1.

For economy the aluminum alloy is in the form of sheet metal less than 0.010" (0.25 mm). A polyester film on the metal sheet is typically 0.0005" (0.0125 mm).

Although this example shows an overall height $h_2$ at 6.86 mm we have also found that useful can ends may be made with an overall height as little as 6.35 mm (0.25").

Figure 5:
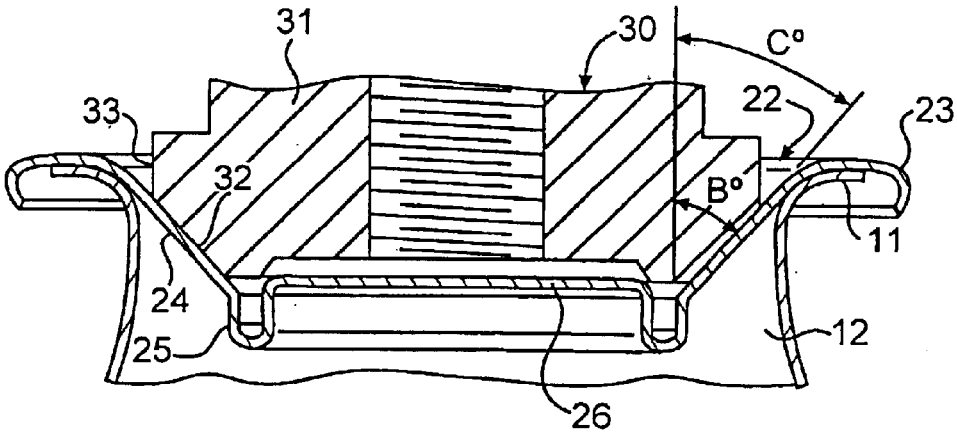
FIG. 5 is a sectioned side view of the can end of FIG. 4 on a can body before forming of a double seam.

FIG. 5 shows the peripheral flange 23 of can end 22 of FIG. 4 resting on the flange 11 of a can body 12 before formation of a double seam as discussed with reference to FIG. 1.

In FIG. 5 a modified chuck 30 comprises a chuck body 31 having a frustoconical drive surface 32 engaging with the chuck wall 24 of the can end 22.

The frustoconical drive surface is inclined outwardly and axially at an angle substantially equal to the angle of inclination C° of between 20° and 60°; in this particular example on chuck angle C of 43° is preferred. The drive surface 32 is a little shorter than the chuck wall 24 of the chuck body. The substantially cylindrical surface portion 33, rising above the drive surface 32, may be inclined at an angle between +4° and −4° to a longitudinal axis of the chuck. As in FIG. 2, this modified chuck 30 has a threaded aperture to permit attachment to the rest of the double seam forming apparatus (not shown).

In contrast to the chuck of FIG. 2 the modified chuck 30 is designed to drive initially on the relatively large chuck wall 32 without entering deeply into the anti-peaking bead 25. Further drive is obtained at the juncture of chuck wall 32 and cylindrical wall 33 as chuck wall of end 24 is deformed during $1^{st}$ and $2^{nd}$ operation seaming FIGS. 6 and 7. The chuck 30 shown in FIG. 5 has an annular bead of arcuate cross section but this bead is designed to enter the chuck wall without scratching or scuffing a coating on the can end; not to drive on the concave bead surface as shown in FIG. 2.

It will be understood that first operation seaming is formed using apparatus as described with reference to FIG. 1.

Figure 6:
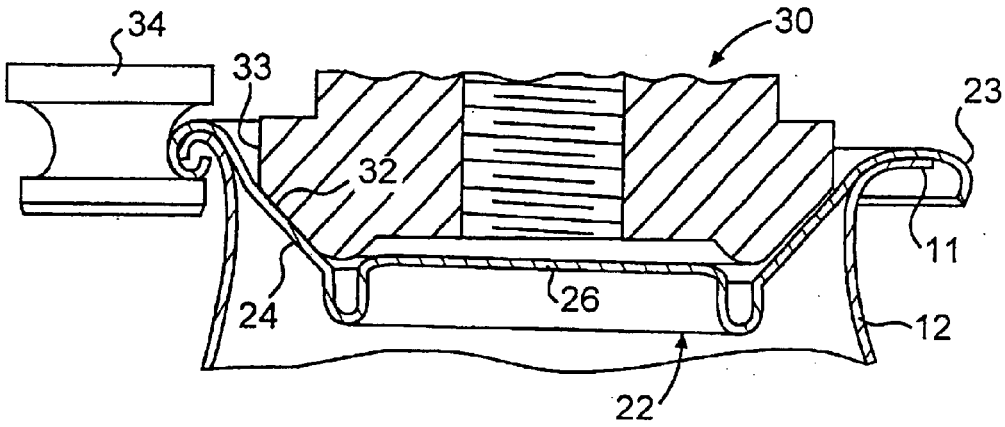
FIG. 6 is a like view of the can end and body during first operation seaming.

FIG. 6 shows the modified can end and chuck during formation of a first operation seam shown at the left of FIG.

2 as formed by a first operation roll 34 adjacent the interfolded peripheral flange of the can end and flange 11 body 12.

During relative rotation as between the can end 22 and first operation roll 34 the edge between the chuck drive wall 32 and cylindrical wall 33 exerts a pinching force between chuck 30 and roll 34 to deform the chuck wall of the can end as shown.

Figure 7:
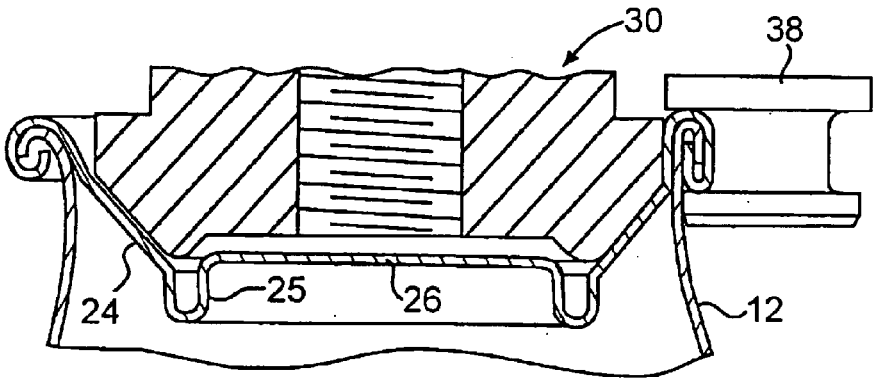
FIG. 7 is a like view of the can end and body during final second operation seaming to create a double seam.

After completion of the first operation seam the first operation roll is swung away from the first operation seam and a second operation roll 38 is swung inwards to bear upon the first operation seam supported by the chuck 30. Relative rotation as between the second operation roll 38 and first operation seam supported by a chuck wall 30 completes a double seam as shown in FIG. 7 and bring the upper portion 24 of the chuck wall 24 to lie tightly against the can body neck in a substantially upright attitude as the double seam is tightened by pinch pressure between the second operation roll 38 and chuck 30.

Can ends according to the invention were made from aluminum alloy 5182 and an aluminum alloy 3004/polymer laminate sold by CarnaudMetalbox under the trade mark ALULITE. Each can end was fixed by a double seam to a drawn and wall ironed (DWI) can body using various chuck angles and chuck wall angle as tabulated in Table 1 which records the pressure inside a can at which the can ends failed:

TABLE 1

| | CAN END DATA | | | PRESSURE IN BAR (PSIG) TO FAILURE FOR VARIOUS SEAMING CHUCK ANGLES B° | | | | |
|---|---|---|---|---|---|---|---|---|
| Sample Code | Material Thickness mm | Minimum Diameter D1 mm | CHUCK Wall Angle "C" | 23° | 10°/23° | 4°/23° | 23° with D. Seam Ring | 10°/23° with D. Seam Ring |
| A | ALULITE 0.23 | 52.12 (2.052") | 21.13° | 5.534 (80.20) | 5.734 (83.10) | 5.311 (76.97) | 6.015 (87.17) | 5.875 (85.14) |
| B | 5182 0.244 | 52.12 (2.052") | 21.13° | 5.599 (81.15) | 5.575 (80.79) | 5.381 (77.99) | 5.935 (86.01) | 5.895 (85.43) |
| C | 5182 0.245 | 52.12 (2.052") | 21.13° | 6.004 (87.02) | 5.910 (85.65) | 5.800 (84.06) | 6.224 (90.21) | 6.385 (92.54) |
| D | ALULITE 0.23 | 51.92 (2.044") | 21.13° | 5.334 (77.31) | 5.229 (75.78) | 5.238 (75.91) | 5.730 (83.04) | 5.404 (78.32) |
| E | 5182 0.224 | 51.92 (2.044") | 21.13° | 5.555 (80.50) | 5.514 (79.92) | 5.354 (77.60) | 5.895 (85.43) | 5.930 (85.94) |
| F | 5182 0.245 | 51.92 (2.044") | 23° | 5.839 (84.63) | 5.804 (84.12) | 5.699 (82.59) | 6.250 (90.58) | 6.435 (93.26) |
| G | ALULITE 0.23 | 51.92 (2.044") | 23° | | | 5.123 (74.25) | | |
| H | 5182 0.224 | (51.92) (2.044") | 23° | | | 5.474 (79.34) | | |
| I | 5182 0.245 | 51.92 (2.044") | 23° | | | 5.698 (82.58) | | |

All pressures on unaged shells in bar (psig). 5182 is an aluminum-magnesium-manganese alloy lacquered. The "ALULITE" used is a laminate of aluminum alloy and polyester film.

The early results given in Table 1 showed that the can end shape was already useful for closing cans containing relatively low pressures. It was also observed that clamping of the double seam with the "D" seam ring resulted in improved pressure retention. Further tests were done using a chuck wall angle and chuck drive surface inclined at nearly 45°: Table 2 shows the improvement observed:

TABLE 2

| | | | | Chuck Angles B° | |
|---|---|---|---|---|---|
| Sample Code | $h_2$ mm (inches) | $h_3$ mm (inches) | $h_4$ mm (inches) | 43° | 43° with seam ring |
| J | 6.86 (0.270) | 2.39 (0.094) | 2.29 (0.09) | 4.89 (70.9) | 6.15 (89.1) |
| K | 7.11 (0.280) | 2.64 (0.104) | 2.54 (0.10) | 4.83 (70.0) | 5.98 (86.6) |
| L | 7.37 (0.290) | 2.90 (0.114) | 2.79 (0.11) | 4.74 (68.7) | 6.44 (93.3) |

Table 2 is based on observations made on can ends made of aluminum coated with polymer film (ALULITE) to have a chuck wall length of 5.029 mm (0.198") up the 43° slope.

It will be observed that the container pressures achieved for samples J, K, L, 4.89 bar (70.9 psig), 4.83 bar (70.0 psig) and 4.74 bar (68.7 psig) respectively were much enhanced by clamping the double seam.

In order to provide seam strength without use of a clamping ring, modified chucks were used in which the drive slope angle C° was about 43° and the cylindrical surface 33 was generally +4° and −4°. Results are shown in Table 3.

TABLE 3

| Results | | | | |
|---|---|---|---|---|
| SAMPLE CODE | MATERIAL | LINING COMPOUND | CHUCK ANGLES DRIVE/WALL | PRESSURE |
| C | 0.224 5182 | with | 43° | 4.60 (66.7) |
| G | 0.23 Alulite | with | 43°/4° | 5.45 (79.0) |
| H | 0.224 5182 | with | 43°/4° | 6.46 (93.6) |
| J | 0.23 Alulite | without | 43°/4° | 5.91 (85.6) |
| K | 0.244 5182 | without | 43°/4° | 6.18 (89.6) |
| L | 0.23 Alulite | without | 43°/−4° | 5.38 (77.9) |

TABLE 3-continued

| Results | | | | |
|---|---|---|---|---|
| SAMPLE CODE | MATERIAL | LINING COMPOUND | CHUCK ANGLES DRIVE/WALL | PRESSURE |
| M | 0.25 Alulite | without | 43°/−4° | 6.20 (89.8) |
| N | 0.23 Alulite | without | 43°/0° | 6.11 (88.5) |
| O | 0.25 Alulite | without | 43°/0° | 6.62 (95.9) |

All Pressures in Bar (PSIG) All Codes
Reform Pad Dia. 47.24 mm (1.860") (202 Dia).
6.86 mm (0.270") unit Depth $h_2$ 2.39 mm (0.094") Panel Depth Table 3 shows Code "O" made from 0.25 mm Alulite to give 6.62 bar (95 psi) Pressure Test Result indicating a can end suitable for pressurised beverages. Further chucks with various land lengths (slope) were tried as shown in Table 4.

TABLE 4

| | CHUCK WALL ANGLE | | | |
|---|---|---|---|---|
| | 43°/0° 1.9 mm TRANSITION | LAND SHARP | 43°/0° 1.27 MM LAND R. 0.5 MM BLEND | |
| VARIABLE CODE | NO. D.SEAM RING | WITH D.SEAM RING | NO. D.SEAM RING | WITH D.SEAM RING |
| 7 | 6.699 (97.08) | 7.017 (101.7) | 6.779 (98.24) | 7.006 (101.54) |
| 8 | 6.315 (91.52) | 6.521 (94.5) | 6.293 (91.2) | 6.236 (90.37) |
| 9 | 6.095 (88.33) | 6.30 (91.3) | 6.238 (90.4) | 6.719 (97.38) |

All Pressures in Bar (PSIG) Code
7=0.25 mm Alulite, 47.24 mm (1.860") Reform Pad, 6.86 mm
(0.270") $h_2$ Depth, 2.38 mm (0.094") Panel; $h_4$ depth= 2.29 mm (0.09")
8=0.23 mm Alulite, 47.24 mm (1.860") Reform Pad, 7.11 mm
(0.280") $h_{2\ Depth,}$ 2.64 mm (0.104") Panel; $h_4$ depth=2.54 mm (0.10")
9=0.23 mm Alulite, 47.24 mm (1.860") Reform Pad, 7.37 mm
(0.290") $h_2$ Depth, 2.90 mm (0.114") Panel; $h_4$ depth= 2.79 mm (0.11")

Table 4 shows results of further development to seaming chuck configuration to bring closer the pressure resistance of ring supported and unsupported double seams.

Table 4 identifies parameters for length of generally vertical cylindrical surface 33 on the seaming chuck 30, and also identifies a positional relationship between the chuck wall 24 of the end and the finished double seam. It will be understood from FIG. 7 shows that the forces generated by thermal processing or carbonated products are directed towards and resisted by the strongest portions of the completed double seam.

Figure 8:
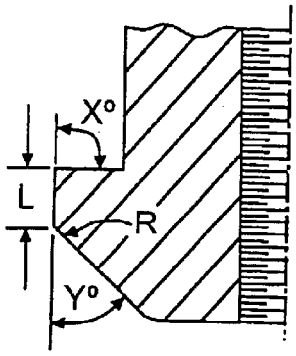
FIG. 8 is a fragmentary section of a chuck detail.

Table 5 shows results obtained from a typical seam chuck designed to give double seam in accordance with parameters and relationships identified in Table 4. Typically: As shown in FIG. 8 the chuck comprises a cylindrical land of length '1' typically 1.9 mm (0.075") and frustoconical drive surface 32 inclined at an angle Y°, typically 43°, to the cylindrical to which it is joined by a radius R typically 0.5 mm (0.020"). Angle "X" is typically 90°.

TABLE 5

| | | DIMENSIONS mm | | PRESSURE | |
|---|---|---|---|---|---|
| CODE | GAUGE | $h_2$ | $h_3$ | bar | (psi) |
| 20 | .23 mm | 7.37 (.290") | 2.36 (.093") | 6.383 | (92.6) |
| 21 | .23 mm | 7.37 (.290") | 2.36 (.093") with compound | 6.402 | (92.8) |
| 26 | .23 mm | 6.87 (.2705") | 2.37 (.0935") | 6.144 | (89.88) |
| 27 | .23 mm | 6.87 (.2705") | 2.37 (.0934") with compound | 6.071 | (88.0) |
| 28 | .23 mm | 7.37 (.290") | 2.36 (.093") | 6.414 | (93.0) |
| 29 | .23 mm | 7.37 (.290") | 2.84 (.112") | 6.725 | (97.5) |
| 30 | .23 mm | 6.86 (.270") | 2.37 (.0935") | 6.062 | (87.9) |
| 31 | .23 mm | 6.86 (.270") | 2.37 (.0935") | 6.013 | (87.2) |
| 34 | .25 mm | 7.37 (.290") | 2.87 (.113") | 7.787 | (112.9) |
| 36 | .25 mm | 7.32 (.288") | 2.34 (.092") | 7.293 | (105.8) |
| 37 | .25 mm | 7.32 (.288") | 2.34 (.092") with compound | 7.402 | (107.3) |
| 38 | .25 mm | 6.87 (.2705") | 2.41 (.095") | 7.077 | (102.6) |
| 516 | .25 mm | 6.35 (.250") | 2.34 (.092") with compound | 6.937 | (100.6) |

All variables made from Alulite, 10 Cans per variable.

The can ends may be economically made of thinner metal if pressure retention requirements permit because these can ends have a relatively small centre panel in a stiffer annulus.

Figure 9:
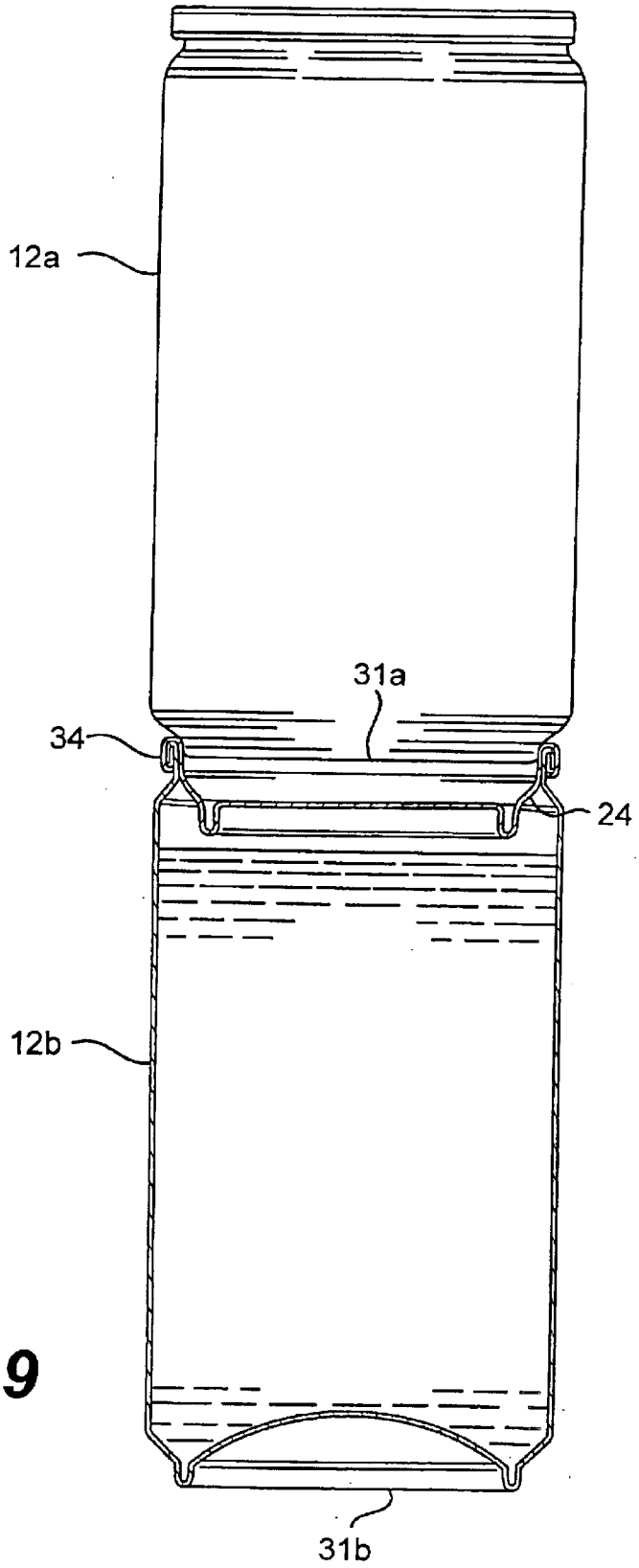
FIG. 9 is a side view of the cans stacked one on the other.

FIG. 9 shows a can 12*a*, closed according to this invention, stacked upon a like can 12*b* shown sectioned so that stacking of the upper can on the lower can end is achieved by a stand bead 31*a* of the upper can fits inside the chuck wall 24 of the lower can end with the weight of the upper can resting on the double seam 34 of the lower can end.

The clearance between the bottom of the upper can body and lower can end may be used to accommodate ring pull features (not shown) in the can end or promotional matter such as an coiled straw or indicia.

Using the experimental data presented above, a computer program was set up to estimate the resistance to deformation available to our can ends when joined to containers containing pressurized beverage. The last two entries on the table relate to a known 206 diameter beverage can end and an estimate of what we think the KRASKA patent teaches.

TABLE 6

| END SIZE Bead OD:ID | OVERALL DIA Mm | PANEL DIA $d_1$ mm | RATIO OVERALL DIA: PANEL DIA | CHUCK WALL ANGLE C. ° | CHUCK WALL LENGTH L mm | RE-ENFORCING RAD $r_3$ mm | INNER WALL HEIGHT $h_3$ mm | OUTER WALL HEIGHT $h_4$ mm | PREDICTED CUT EDGE Ø (*DENOTES ACTUAL) | ACTUAL THICKNESS TO CONTAIN PSI |
|---|---|---|---|---|---|---|---|---|---|---|
| 206–204 | 64.39 (2.535") | 49.49 (1.9485") | 1.3010 | 33.07° | 4.22 (0.166") | 0.52 (0.0204") | 2.34 (0.092") | 1.78 (0.070") | 75.230 (2.9618") | 0.255 |
| 206–202 | 64.39 (2.535") | 47.33 (1.8634") | 1.3604 | 42.69° | 4.95 (0.195") | 0.52 (0.0204") | 2.34 (0.092") | 1.78 (0.070") | 74.272 (2.9241")* | 0.255 |

TABLE 6-continued

| END SIZE Bead OD:ID | OVERALL DIA Mm | PANEL DIA $d_1$ mm | RATIO OVERALL DIA: PANEL DIA | CHUCK WALL ANGLE C. ° | CHUCK WALL LENGTH L mm | RE-ENFORCING RAD $r_3$ mm | INNER WALL HEIGHT $h_3$ mm | OUTER WALL HEIGHT $h_4$ mm | PREDICTED CUT EDGE Ø (*DENOTES ACTUAL) | ACTUAL THICKNESS TO CONTAIN PSI |
|---|---|---|---|---|---|---|---|---|---|---|
| 206–200 | 64.39 (2.535") | 45.07 (1.7744") | 1.4287 | 50.053° | 5.82 (0.229") | 0.52 (0.0204") | 2.34 (0.092") | 1.78 (0.070") | 73.713 (2.9021") | 0.255 |
| 204–202 | 62.18 (2.448") | 47.33 (1.8634") | 1.3137 | 29.78° | 3.96 (0.156") | 0.52 (0.0204") | 2.34 (0.092") | 1.78 (0.070") | 73.767 (2.9042") | 0.24 |
| 204–200 | 62.18 (2.448") | 45.07 (1.7744") | 1.3796 | 40.786° | 4.70 (0.185") | 0.52 (0.0204") | 2.34 (0.092") | 1.78 (0.070") | 72.911 (2.8705") | 0.24 |
| 202–200 | 71.98 (2.834") | 45.07 (1.7744") | 1.597 | 30.266° | 4.09 (0.161") | 0.52 (0.0204") | 2.34 (0.092") | 1.78 (0.070") | 71.984 (2.834") | 0.225 |
| 206 std | 64.69 (2.547") | 51.92 (2.044") | 1.2461 | 15.488° | 4.39 (0.173") | 0.56 (0.022") | 2.03 (0.080") | — | 76.454 (3.010")* | 0.28 |
| KRASKA estimate | 64.39 (eg 2.535") | — | — | 15° | 2.54 (0.100") | 0.81 (0.032") | 1.65 (0.065") | 2.29 (0.090") | 78.080 (3.074") | 0.292 (0.0115") |

All experiments modeled on a notional aluminum alloy of yield strength 310 mpa 0.25 mm thick. The standard was also 310 mpa BUT 0.275 mm thick.

What is claimed is:

1. An apparatus for seaming a peripheral curl of a can end onto a flange of a can body, said can end having a wall extending radially inward from said peripheral curl and inclined between about 20° and about 60° with respect to a central axis of said can end, comprising:

a) a chuck for locating within said can end, said chuck comprising upper and lower circumferentially extending walls forming a juncture therebetween, said lower wall inclined away from said upper wall so as to form a driving surface between said upper and lower walls, said driving surface subtending an angle of between about 120° and 150°, said upper wall being substantially cylindrical; and b) at least one seaming roll adapted to urge an upper portion of said inclined wall of said can end against said upper wall of said chuck so as to deform said peripheral curl and said flange into a seam joining said can end to said can body.

2. The apparatus according to claim 1, wherein said substantially cylindrical wall is inclined with respect to said central axis by not more than about 4° such that said driving surface subtends an angle of between 116° and 154°.

3. The apparatus according to claim 1, wherein said driving surface subtends an angle of between about 130° and 150°.

4. The apparatus according to claim 3, wherein said driving surface subtends an angle of between about 135° and 140°.

5. An apparatus for seaming a can end onto a flange of a can body, said can end having a circumferentially extending peripheral curl and a wall extending circumferentially and radially inward from said curl and an annular reinforcing bead extending radially inward from said wall, said reinforcing bead having an interior surface, said peripheral curl comprising a seaming panel and a radiused portion extending from said seaming panel to said wall, comprising:

a) a chuck for locating within said can end, said chuck comprising (i) upper and lower circumferentially extending walls forming a juncture therebetween, said lower wall inclined away from said upper wall so as to form a driving surface therebetween, said driving surface subtending an angle of between about 120° and 150°, said upper wall being substantially cylindrical, and (ii) a downwardly extending annular bead, said chuck annular bead sized and located so as not to contact said interior surface of said can end annular reinforcing bead when said chuck is located within said can end; and b) at least one seaming roll adapted to urge an upper portion of said inclined wall of said can end against said upper wall of said chuck so as to deform said peripheral curl and said flange into a seam joining said can end to said can body.

6. The apparatus according to claim 5, wherein said substantially cylindrical wall is inclined with respect to said central axis by not more than about 4° such that said driving surface subtends an angle of between 116° and 154°.

7. The apparatus according to claim 5, wherein said driving surface subtends an angle of between about 130° and 150°.

8. The apparatus according to claim 7, said driving surface subtends an angle of between about 135° and 140°.

9. The apparatus according to claim 5, wherein said lower wall of said chuck is adapted to drive rotation of said can end and said can body while said chuck is located within said can end.

10. The apparatus according to claim 5, wherein said juncture between said upper and lower walls of said chuck is adapted to drive rotation of said can end and said can body while said chuck is located within said can end.

11. An apparatus for seaming a peripheral curl of a can end onto a flange of a can body, said can end having a wall extending radially inward from said peripheral curl, comprising:

a) a chuck adapted to be located within said can end, said chuck comprising upper and lower circumferentially extending surfaces forming a juncture therebetween, said upper surface being substantially cylindrical, said lower surface extending inwardly and downwardly from said upper surface to an end point of said lower surface such that a line between the juncture and the end point of the lower surface is inclined between about 30° and about 60° with respect to a central axis of said chuck; and b) at least one seaming roll adapted to urge an upper portion of said wall of said can end against said upper surface of said chuck so as to deform said peripheral curl and said flange into a seam joining said can end to said can body.

12. The apparatus according to claim 11, wherein said line between the juncture and the end point of the lower surface is inclined between about 30° and about 50° with respect to said central axis of said chuck.

13. The apparatus according to claim 11, wherein said line between the juncture and the end point of the lower surface is inclined between about 40° to about 45° with respect to said central axis of said chuck.

14. The apparatus according to claim 11, wherein said lower surface between the juncture and the end point of the lower surface is straight.

15. The apparatus according to claim 11, wherein said chuck lower surface between the juncture and the end point of the lower surface forms a frustum of a right circular cone.

16. The apparatus according to claim 11, wherein said chuck further comprises a bead extending from said end point of said lower surface.

17. The apparatus according to claim 16, wherein said bead is circumferential.

18. The apparatus according to claim 16, wherein said bead does not have driving contact with a concave surface of a reinforcing bead of the end during seaming.

19. The apparatus according to claim 16, wherein said bead has an arcuate shape in cross section.

20. The apparatus according to claim 19, wherein an outer portion of said arcuate shape of said bead extends directly from the end point of the lower surface.

21. The apparatus according to claim 11, wherein said substantially cylindrical surface is inclined with respect to said central axis by not more than about 4°.

22. The apparatus according to claim 11, wherein said juncture between said upper and lower surfaces of said chuck forms a driving surface for contacting the end during seaming.

23. The apparatus according to claim 22, wherein said chuck between said juncture and said end point of the lower surface forms another driving surface for contacting the end during seaming.

* * * * *

UNITED STATES PATENT AND TRADEMARK OFFICE

CERTIFICATE OF CORRECTION

PATENT NO. : 6,877,941 B2
APPLICATION NO. : 10/741492
DATED : April 12, 2005
INVENTOR(S) : Mouayed Mamdooh Brifcani et al.

It is certified that error appears in the above-identified patent and that said Letters Patent is hereby corrected as shown below:

Title Page,
Item (75), Inventors:
Delete "Peter James Hinton, Swindon (GB);" and insert -- Peter James Hinton, Wiltshire (GB); --.
Delete "Mark Christopher Kysh, Wantage (GB): and insert -- Mark Christopher Kysh, Oxfordshire (GB) --.

Title Page,
Item (30), Foreign Application Priority Data:
Delete "9510515" and inesrt -- 9510515.1 --.

Title Page,
Item (56) References Cited, OTHER PUBLICATIONS:
Page 2, "Notice of Opposition to a European Patent 96908205.6/828," reference, delete "Can-Company" and insert -- Can Company --.

Column 1,
Line 30, delete "10" and insert -- 10° --.

Column 7,
Line 43, delete "$h_{2\ Depth,}$" and insert -- $h_2$ Depth, --.

Signed and Sealed this

Twenty-sixth Day of June, 2007

JON W. DUDAS
*Director of the United States Patent and Trademark Office*